US005472028A

United States Patent [19]

Faulhaber

[11] Patent Number: 5,472,028

[45] Date of Patent: Dec. 5, 1995

[54] METHOD AND APPARATUS FOR MANUFACTURING WOOD PRODUCTS FROM TREE TRUNKS

[75] Inventor: Heinz-Dieter Faulhaber, Oberkirch, Germany

[73] Assignee: Gebruder Linck, Germany

[21] Appl. No.: 243,971

[22] Filed: May 17, 1994

[51] Int. Cl.[6] ..... B27C 9/00; B27B 1/00; B27M 1/08

[52] U.S. Cl. ..... 144/357; 83/368; 83/425.2; 83/711; 144/3 R; 144/39; 144/242 R; 144/242 L; 144/367; 144/369; 144/377

[58] Field of Search ..... 83/861, 368, 425.2, 83/707, 708, 710, 711; 144/1 R, 3 R, 39, 41, 356, 357, 359, 367, 369, 370, 377, 378, 242 L, 245 R, 242 R

[56] References Cited

U.S. PATENT DOCUMENTS

| | | | |
|---|---|---|---|
| 3,457,978 | 7/1969 | Ahlstedt | 144/370 |
| 3,552,457 | 1/1971 | Bos | 144/3 P |
| 3,612,119 | 10/1971 | Neild | 144/39 |
| 4,015,648 | 4/1977 | Shephard | 144/39 |
| 4,139,035 | 2/1979 | Bystedt et al. | 144/356 |
| 5,143,127 | 9/1992 | Rautio | 144/39 |
| 5,224,530 | 7/1993 | Wolf | 144/39 |
| 5,228,490 | 7/1993 | Wolf | 144/378 |

*Primary Examiner*—W. Donald Bray
*Attorney, Agent, or Firm*—Donald S. Holland; Richard H. Kosakowski; Holland & Associates

[57] ABSTRACT

The invention concerns a method apparatus for the manufacture of wood products from tree trunks in the form of an integral work station utilizing modern splinter-chipping technology. In a preferred embodiment a tree trunk (6) is alignable on a feeder carriage (4) for optimal utilization of the wood, on the feeder carriage (4), and is moveable by means of the carriage lengthwise in the working zone (8). Laterally modular tool units (10, 12, 14, 16) are provided alongside the working zone (8). They are of modular design and can optionally, for a selective processing sequence, be brought into engagement with the tree trunk repeatedly passing by.

12 Claims, 3 Drawing Sheets

METHOD AND APPARATUS FOR MANUFACTURING WOOD PRODUCTS FROM TREE TRUNKS

BACKGROUND OF THE INVENTION

The invention concerns an apparatus for the manufacture of wood products from tree trunks, comprising feeding means for the reception of a tree trunk, said means being moveable together with the tree trunk along a feeding track laid substantially in the longitudinal direction of the tree trunk, said feeding track including a working zone with an arrayed series of tools, which are moveable into woodworking contact with the tree trunk in motion along the working zone. The objective of this invention is also a means in the installation for advancing the trunk adaptable in special configuration.

Saw frames and band saws are generally known from older technology with which a tree trunk is divided into boards by being moved on a carriage positioned in relation to a saw blade. The carriage is moveable in a fore and aft direction, and with each movement forward only one cut can be made. This older technology is now widely being abandoned in order to make way for modern splinter-chipping and profiling technology.

In installations where use is made of forming technology, a tree trunk is generally worked in a single pass whereby the trunk is, for example, first flattened along its sides, then corners at the tree trunk periphery are milled out, boards are separated from the sides, and the edged heart wood is, when possible, cut into further products like boards and beams. Such installations generally work automatically and are designed for a relatively high through-put.

The advance of the tree trunks through such installations is generally accomplished by means of stationary pairs of feeding rollers, partially aided by conveyers with corresponding dogs. The application of tools is carried out in the rule simultaneously from opposing sides.

These modern forming installations have not only the disadvantage for small production output that they require a very high level of capital cost but also that they work mostly with a fixed method of positioning and direction of insertion of the tree trunk into the installation. An attempt is usually made to position the trunks in the direction of their central axis, whereby the chippers for the leveling of the tree trunk have to chip off even more material because of the taper of the trunk the further down they engage with the lower end of the tree trunk.

Especially in South American countries the branches of the trunk are removed when the tree is young, so that the lateral growth of the trunk continues free of branches. The best clear wood is thus found in the outer portion of the trunk, while the heart still contains the branches of earlier growth.

It is therefore customary for reasons of quality in South American countries to separate wood products from the outer portion of the trunk not parallel to the central axis but rather parallel to the outer surface line. Modern forming installations are not designed for this procedure.

The invention is thus intended as a mechanism for the production of wood products, which on the one hand employs modern forming technology and on the other hand is cost effective for smaller businesses and smaller through-put, and beyond that also allows for a method of operation in which a tree trunk can be processed from one side or several sides substantially parallel to the outer surface line.

This task is carried out with a mechanism invented basically as according to the characteristic features of patent claim 1.

From U.S. Pat. No. 3,457,978 a forming installation is previously known in which a tree trunk is clamped on a carriage on a track and transported past several work stations in series. The purpose of this known installation is, however, to allow for central control of the finished and waste products. The track is formed as sort of closed circuit around the equipment, which makes for a very costly installation in that it contains as many work stations as are required for the various steps of processing and is thus intended for a continual through-put of wood. It has no way to mount a tree trunk other than in its axial direction.

SUMMARY OF THE INVENTION

As a solution to the problem, the invention provides a straight or generally linear advance path along which the means of transportation of the tree trunk is moveable in both directions.

In a section designated as the work station zone, tools mounted on drive units are installed which can be brought into contact as desired with the trunk passing by in that they can be drawn back and forth between the working zone and an idle position further back.

The advance mechanism is preferably designed as a carriage on a track and is equipped with a holding and clamping device. This mechanism is arranged so that it has two chucks or clamping members separated from each other such that they grip the tree trunk from the top and bottom respectively, as viewed along the axis, so that the other longitudinal side of the trunk is not hindered as regards the application of the cutting tools. The cutting tools are arrayed on only one side of the advance mechanism and track, namely on the side that is free for an application of tools on a clamped-in tree trunk.

The mechanism is designed for a method of application whereby the tree trunk is brought back along the track after being advanced past a tool or a series of tools so that it can be brought forward again in contact with another tool placed into working position or with the same series of tools as before. In this way a tree trunk is reduced to wood products from one side by a series of successive single passes through the processing line. Naturally this does not exclude the possibility of turning or otherwise clamping the tree trunk after working one side in order to process another side.

The method of using the equipment described above allows for the installation of just one type of tool on each drive unit. This does not mean that a drive unit may be equipped only with a single tool. In the case of most tools it is more normal that they are arranged in pairs so that they can be applied on the sides of a tree trunk to be processed. For example, a cut for the separation of a board can generally be accomplished simultaneously from above and below by two circular saw blades arranged in an offset array when the cutting depths intersect. The same holds for corner milling cutters for the exposing of a side board. Here it is necessary to mill out an upper and a lower corner, which generally is accomplished simultaneously with symmetrically arranged tools. The fact that one needs to provide only one of each type of tool (singly or in pairs) due to the ability to pass the trunk repeatedly down the processing line considerably reduces the required capital cost. Beyond this the installation permits a high level of flexibility in processing, since the individual tools can be brought into contact with the tree trunk as often as required in any changed position for each pass down the processing line. Thus even with a low cost of capital investment the working of wood with modern tools suited to each required step of processing is possible.

The tree trunk must be drawn back on the advance mechanism to its starting position for each new pass, which means that it could collide with tools still in position to contact the trunk. By shifting the tools to the idle position the way could be made clear for the backward pass of the trunk, but such a solution would be unpractical if for every new pass the same specified series of tools had to be brought into contact with the trunk. In a preferred embodiment the holder for clamping the trunk onto the advance mechanism is made so that it can be displaced on the carriage as a whole transversely to the direction of advance. This can if so desired be done by means of automatic control. On the way back, the clamping holder can thus be moved to the side on the advance mechanism away from the tools transversely to the feeding means after reaching the starting position in order to be moved again either by hand or automatically into the correct orientation for the next application of tools.

In order to clamp a tree trunk into a desired position on the advance mechanism, it is however advantageous that the means of clamping be constructed so that they are adjustable in height and horizontal placement at least relative to each other transversely to the track. If the processing of a tree trunk is undertaken parallel to one of its outer surface lines, the axis of the trunk must run at an acute angle to the direction of advance, which requires a corresponding positioning of the means of clamping.

Provisions for adjusting a clamping device on a transport carriage in a substantially horizontal plane are already familiar in feeder carriages in traditional band saws. An innovation in the present invention is the adjustability of the clamping device on an advance mechanism in a vertical plane, whereby it is essentially a matter of being able to tip the axis of a clamped-in tree trunk in a vertical plane. This is important in order to determine the position of the surface of a vertical cut along the length of the trunk in relation to the contact tracks of the edge milling cutters, which limit a board to be separated, such that an optimal utilization of the sectional area of the trunk in its plane of cut along the length is yielded.

In order to be able to undertake a corresponding positioning of the trunk on the transport carriage, a proven electronic measuring device is provided at the entrance of the processing track on the preferred embodiment of the invention with which the position of the tree trunk can be calibrated in order to correct for an optimal utilization of wood according to the results of measurement for its position.

Even if the alignment of the tree trunk in a vertical plane was not of importance for the utilization of wood in a traditional band saw installation, because no lateral limitation of the board in the separation of a board from a tree trunk is undertaken and the question of the optimal utilization of the many edged board is addressed only when it is subsequently edged, the advance mechanism of the present invention can be employed even in traditional band saw installations for the following reasons: band saw blades tend to chatter. For this reason vertically adjustable guides are provided at the saw blade, which are brought as close as possible from above and below to the trunk being worked. This can be accomplished automatically during the working of a trunk so that the guides substantially follow the contour of the trunk. If the trunk is crooked or lies on the transport carriage tilted in its orientation as to height, the adjustability requirement of the saw band guides is increased. Through use of an advance mechanism as in the present invention, if necessary in conjunction with an electronic trunk measuring device, the trunk can be aligned in its horizontal position such that the adjustment of the saw band guides can be reduced to a minimum.

It would in principle suffice with provision of only two proximate clamping devices for a tree trunk on a transport carriage, either with the one clamping device moveable transversely and adjustable in height or the one clamping device moveable transversely and the other set to adjust in height on the transport carriage. In order to hold especially a heavy tree trunk securely, it is advantageous to provide more than two clamping devices, whereby a coordinated adjustability of all clamping devices must be provided, which requires a greater technical input.

Since it essentially depends on the tipping of the axis of a tree trunk in a horizontal and/or vertical plane, the advance mechanism of the preferred embodiment is designed so that the entire clamping means is fixed on the transport carriage in such a way that it can be tipped at least around a horizontal axis. This can be handled so that all clamping devices are arranged on a common mount base, which in form of a counterpoise rocker on the transport carriage can be swiveled in a vertical plane a horizontal axis.

A corresponding construction with a perpendicular axis of rotation can be provided in addition to a parallel transverse displacement of the clamping device for the swiveling of the tree trunk in a horizontal plane.

Additional devices can be provided on the transport carriage, with which the tree trunk can be turned after release of the clamping devices and clamped again in a different work position.

The drive units carrying the tools on the processing track are, in its total installation of the present invention, arranged so that they follow each other closely without gaps. It can be an advantage to standardize the drive units with respect to their base dimensions or their moveable guidance in modular design. It would then be possible to exchange or to optionally install them in various positions alongside the working zone.

A meaningful sequential arrangement would be the following, wherein the first drive unit is equipped with one or two chipper head portions for the flattening of the outside of a tree trunk, the second drive unit is provided with two edge millers which preferably are rotative about vertical shafts and can cut out corners, from above and from below, at the tree periphery, and the third drive unit is equipped with two circular saw blades which are rotative about horizontal shafts, arranged slightly offset relative to each other in the feeding direction, and capable of separating a board from the trunk in one vertical cut. In a first pass of the tree trunk through the working zone, all three drive units can be in an operative position. For a second pass the first drive unit with the chippers is brought into the idle position, the edge millers are moved slightly away from each other, and the clamping device on the feeding means is moved more closely onto the tools to separate, in a similar working procedure, a second board from the trunk. This can be done again and again.

With the same setting of the tools, it is of course also possible to turn the trunk before the next pass on the feeder carriage. The board would for example be exposed at a 90° C. rotated trunk position or at an opposite side of the trunk.

A drive unit provided for severing saws can also be equipped with saw shafts, which are mounted to receive several saw blades, arranged at a selective, mutual distance and intended for simultaneous separation of several boards. Such configurations are known.

Following the concept of the apparatus according to the invention, it is also possible during the pass of the tree trunk through the working zone to move into operative position only one drive unit, and to move in another one for the next advance.

With respect to the multitude of the individual tool types, it is additionally possible to provide a tool unit with a stationary blade so that when the tree trunk passes by, at the blade, a thin board is separated from the trunk without any removal of chips. Since such a blade does not require its own drive, the expression "tool unit" is here used instead of drive unit. A tool unit equipped with a knife should also, in agreement with the other drive units, be moveable back and forth between an operative and an idle position.

In the following, an exemplary embodiment of the invention is described with reference to the accompanying drawings.

DETAILED DESCRIPTION OF THE PREFERRED EMBODIMENTS

Figure 1:
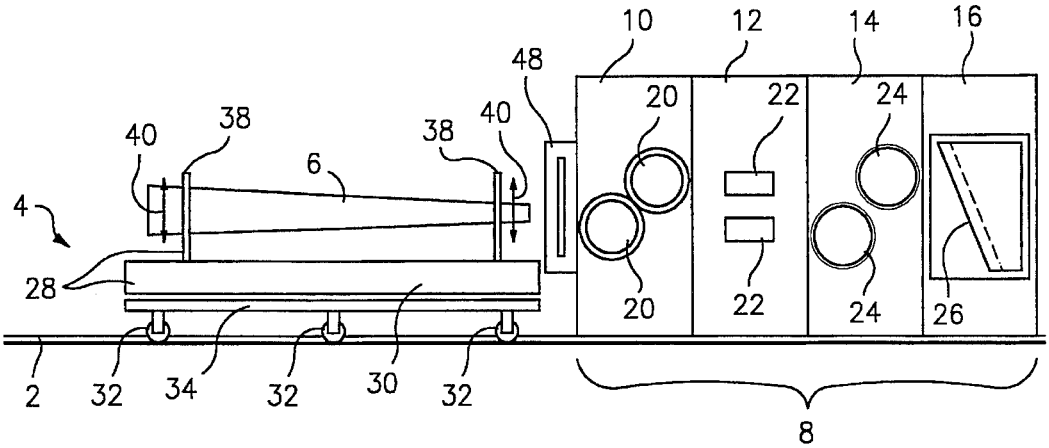
FIG. 1 is a schematic elevation view showing an integral work station for the manufacture of wood products made from tree trunks.
Figure 2:
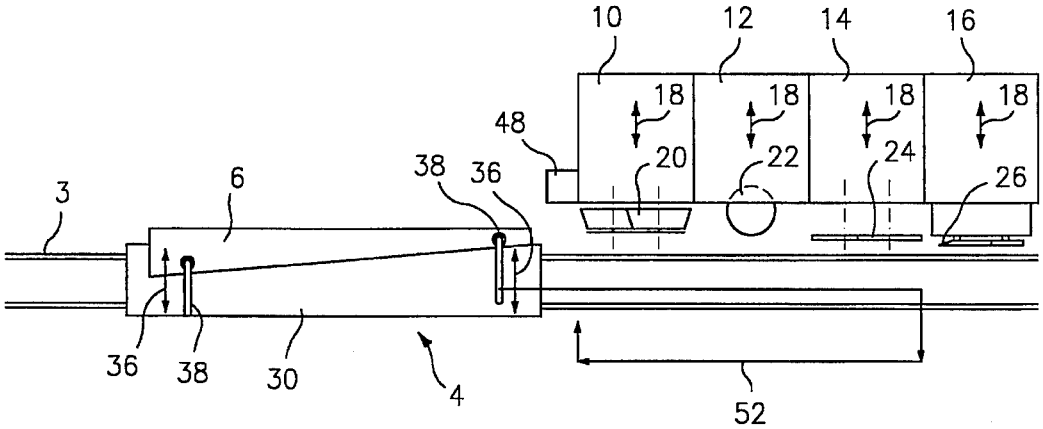
FIG. 2 is a schematic top view of the station according to FIG. 2.

The integral work station shown in a schematic front view in FIG. 1 and in a schematic top view in FIG. 2 is intended for the manufacturing of wood products of tree trunk wood. It has a feeding track 2 which, in the exemplary embodiment, is formed as a linear rail section. On this rail section 3 there is arranged a feeder carriage 4, which is moveable backwards and forwards and intended for the reception of a tree trunk 6 to be worked on. A portion of the feeding track 2 constitutes a working zone 8, along which an array of drive and working units 10–16 are provided laterally to the feeding track 2. Said units 10–16 are equipped with various working tools on their front side facing the feeding track 2. The individual drive units are moveable transversely to the direction of the feeding track 2, individually between a working position at the feeding track and a rest position away from the feeding track, which is schematically indicated by arrow 18 in FIG. 2. In the illustration of FIG. 2 all the drive units are in the working position.

In the exemplary embodiment the drive unit 10, which is arranged first in the feeding direction of the carriage 4, is provided with two splinter-chipping head portions 20. These are displaced relative to each other in the horizontal direction and, in the vertical direction, arranged in an overlapping way. Such splinter-chipping head portions are known and are used to flatten one side of the tree trunk, whereby the worked wood material falls out in the form of chips. The next drive unit 12 is provided with two vertically above each other arranged corner milling machines 22 which are rotative about vertical shafts. The two millers are adjustable in their relative distance to each other. Their function is to cut out two corner areas in the wood trunk that expose the thin sides of a side board which is to be separated. The edge millers are equipped at their periphery with chopping blades (not shown), with which the corner material can also be turned into chips. At the sides of the chopping blades facing each other they may also include an additional fine working tool, by means of which the side edges of the exposed board directly undergo a fine or saw cut treatment. This design and arrangement of the tool is also previously known.

The drive unit 14 is equipped with two circular saw blades 24, which are also offset in horizontal direction and, in their engagement areas, arranged vertically slightly overlapping so that a side board that is to be separated from the trunk will release. The shafts of the circular saw blades can, in a previously known way, also be provided with several circular saw blades positioned at a distance from each other in order to separate several side boards at the same time. The last unit, which has no drive means and therefore is called working unit 16 carries a stationary cutting blade 26 by means of which, through a clean cut, a side board can be sliced off from the tree trunk passing by.

The feeder carriage 4 is equipped with a clamping device for a tree trunk. It is generally designated with the reference numeral 28. The device 28 has a base frame 30 that is moveable on the chassis 34, which is equipped with wheels 32, in a horizontal direction transverse to the feeding track; such horizontal movement being indicated by the arrows 36 in FIG. 2. The crosswise motion capability of the base frame 30 can be effected by a motor means or a fluid-propelled means.

Figure 4:
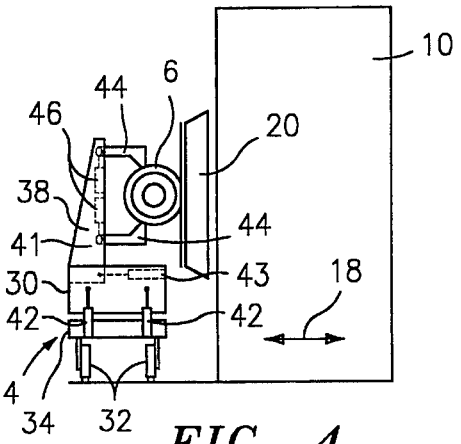
FIG. 4 is a schematic front view towards the cross section A—A in FIG. 3.
Figure 5:
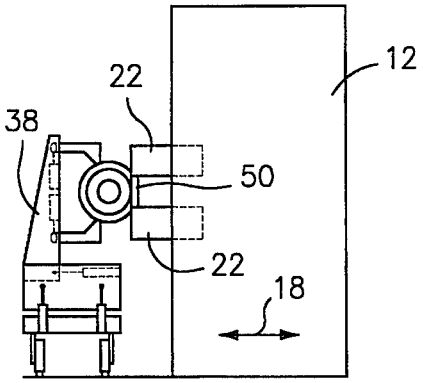
FIG. 5 is a schematic front view towards the cross section B—B in FIG. 3.
Figure 6:
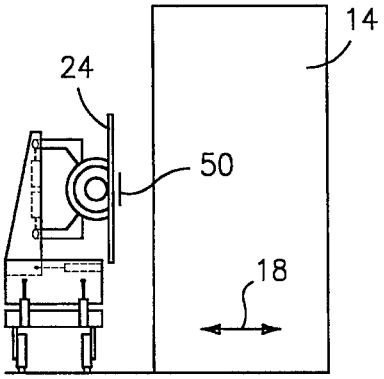
FIG. 6 is a schematic front view towards the cross section C—C in FIG. 3.

The clamping device 28 further includes two clamping members 38 provided on the base frame 30 and positioned, in the direction of the feeding track, at a distance from each other. Said members 38 are equipped with a vertical height adjustment means the vertical movement of which is indicated in FIG. 1 by the arrows 40. The principal design of the clamping means in this example of an inventive embodiment is shown in FIGS. 4–6. Said clamping members 38 have each a pillar 41 provided with a gripper pair 44 which is closable vertically. Its two arms are maneuverable by means of fluid cylinders 46. Since, in the exemplary embodiment, a separate cylinder 46 is provided for each arm of the gripper pair 44, it is made possible for the arms of the gripper pair to not only close up jointly but also to move individually, whereby a specific height adjustment of the tree trunk 6 is possible. For this purpose the cylinders 46 may be equipped with position guide means (not shown). The fluid drive can for instance be arranged such that the gripper pair is closed by the fluid cylinders 46 but that, in addition, also a vertical movement of the gripper pair as integral unit is possible.

With the help of the height-adjustable means (gripper pairs 44) the axis of a clamped tree trunk 6 can be straightened vertically in the way desired. In order to optimally provide for such straightening, there is disposed at the entrance of the working zone 8, i.e. in front of the first drive unit 10, an electronic measuring device 48 with which the tree trunk 6 is measured in its position during its by-passing movement on the feeder carriage 4. The electronic measuring device 48 may also be arranged at another place of the feeding track 2, particularly at a greater distance from the working zone 8. Measuring devices of the kind that is suitable for measuring are previously known. The measuring result can be utilized to automatically affect the adjustability in height for the clamping means 38.

The axis of the clamped tree trunk 6 can be further adjusted vertically through use of one or more additional fluid cylinders 42 that connect between the chassis 34 and base frame 30. The cylinders 42 allow for relative movement of the base frame 30 with respect to the chasis 34. Further, fluid cylinders 43 allow for relative movement of the pillars 41 with respect to the base frame 30. Each pillar 41 can be moved independently of all others by such cylinders 43. This allows for selective adjustment along a horizontal axis of the axis of the clamped tree trunk.

Figure 3:
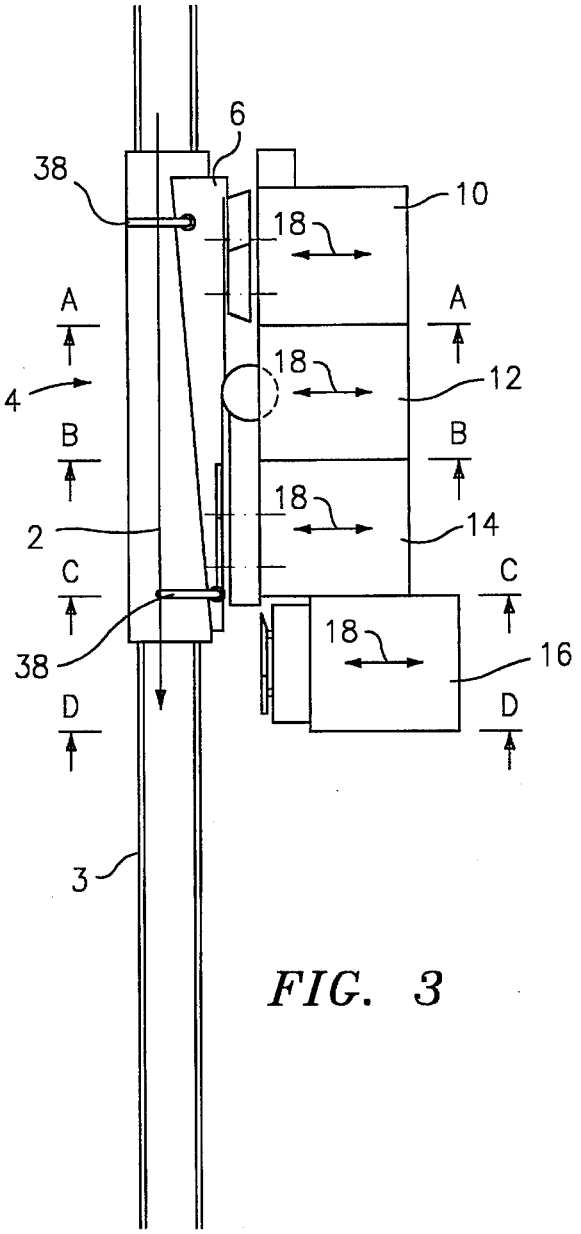
FIG. 3 is a top view corresponding to FIG. 2 showing the feeder carriage for the trunk wood in the working zone.

The FIGS. 3–7 illustrate the operative capability of the individual tools in position near the tree trunk 6. Referring to FIG. 4, it should first of all be noted that the tree trunk 6 is held substantially to the side of its central axis, and more specifically on that side which faces away from the side where the tool is intended to engage. In the top view of FIG. 3 the feeder carriage 4 is with the tree trunk 6 positioned in the working zone, i.e. a number of tools are engaged with the tree trunk. It is also visible in FIG. 3 that the tree trunk, in relation to a horizontal plane, is not clamped in such a way that its axis runs in the direction of the feeding track 2, but rather that the side of the tree trunk that is undergoing woodworking is straightened parallel with the feeding track 2. The trunk adjustment possibilities rendered by all of the abovedescribed means for adjustment of the tree trunk provided on the feeder carriage 4 deliberately afford such straightening of the tree trunk parallel to the feeding track 2. In the illustration of FIG. 3 the working unit 16 is with the cutter blade 26 in a position of repose. The drive units 10, 12 and 14 are all in an operative position and their tools consecutively enter, in this order, into working engagement with the tree trunk 6 during its advancing along the rails 3.

The front view in FIGS. 4–6 show the individual, consecutive working steps. It is seen in FIG. 4 that the tree trunk is being flattened at the side thereof facing drive unit 10. FIG. 5 shows the subsequent application of the edge millers 22 on drive unit 12. From above and below, respectively, there is milled out a tree peripheral corner from the trunk, whereby the side board 50 to be separated is exposed at its edges. FIG. 6 finally illustrates how this side board 50 is separated from the tree trunk 6 with the aid of the circular saw blades 24.

This procedure can be repeated for the next side board. The drive unit 10 with the chippers has then to be moved into an idle position and the edge millers 22 of drive unit 12 to be adjusted at a greater distance. The progressive movement of the base frame 30 of the clamping device 28 is indicated in FIG. 2 by the arrow sequence 52. After the tree trunk 6 has moved alongside the tools, the clamping device 28 is moved away transversely on the carriage 4, at a certain distance to the tools, for a return transport of the carriage, and a renewed advance after another approach of the tools.

Figure 7:
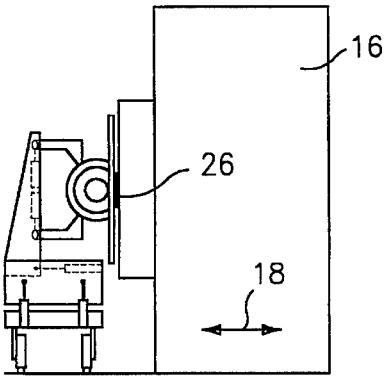
FIG. 7 is a schematic front view towards the cross section D—D in FIG. 3

It is of course possible, before a renewed movement through the working zone 8, to turn the tree trunk 6 in the clamping device 28 so that the following working step is carried out at another side of the tree trunk. Also, the processing sequence has by no means been established to occur in the order that is shown in FIGS. 3–6. On the contrary, all the drive and work units can be put in an operative position individually or in selected sequence. FIG. 7 shows the case where the work unit 16 with cutter blade 26 is engaged with the tree trunk 6 to sever instead of to saw the side board. The preceding processing steps can be accomplished as shown in FIG. 3, namely first flattening and edge milling. The edges can from the beginning also be made so deep that several thin boards will be sliced off or several boards simultaneously separated through the exposed trunk section. It is for instance also possible through several consecutive applications of the edge miller to cut out stepped corners at different distances, to simultaneously separate more boards of different breadths and, thus, to enhance the utilization of the trunk cross section.

It is evident through the examples that the described integral work station provides very high flexibility with regard to the various processing possibilities without requiring the investment cost of a big facility.

Figure 8:
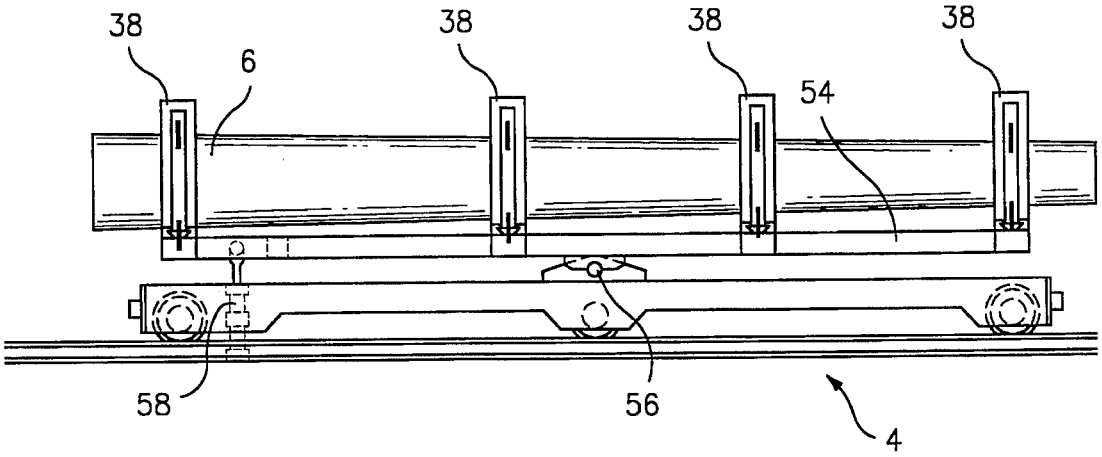
FIG. 8 is another embodiment of a feeder carriage.

In FIG. 8 there is finally shown an alternate and preferred embodiment of the feeder carriage 4. The base frame 54 of the clamping device is here mounted on the carriage chassis rotatably about a horizontal axle 56 which extends transversely to the feeding track. The horizontal alignment of the axis of the tree trunk 6 can thereby be corrected in a simple way. As a setting device for the tipping motion there is provided on one side only a fluid cylinder 58, which can be equipped with suitable guiding means. It is with this embodiment without any problem possible to arrange more than two clamping members for a safer and stronger hold of the tree trunk 6. Their gripper arms would then only be needed for the closing movement, and it would not be needed to integrate guiding means for the height position.

The drive of the feeder carriage 4 along the feeding track 2 can be accomplished in any known and suitable way, for example by rack gear as known from cog wheel railways. The drive means for the feeder carriage 4 are not shown in the drawings.

It can be seen in the drawings that the drive and work units are illustrated schematically in the same size. Preferably they have a modular design so that they can readily be replaced with others as well as positioned, in their order, alongside the working zone 8 in a different arrangement.

In principle, it is also possible to configure the advance mechanism in such a way that the processing steps can be carried out also during the return pass of the feeder carriage. In this case, direction dependency in the machine tools might make it necessary to move into operative position drive units that are specifically designed to meet that dependency.

What is claimed is:

1. Apparatus for the manufacture of wood products from a tree trunk, comprising feeding means for carrying the tree trunk, the feeding means being moveable together with the tree trunk along a feeding track running substantially in the longitudinal direction of the tree trunk, at least a portion of the said feeding track including a working zone having an arrayed series of a plurality of tools disposed adjacent to the working zone of the feeding track, a selected one or more of the plurality of tools being moveable into and out of woodworking contact with the tree trunk, characterized in that the feeding means are moveable both in backward and forward directions along the generally linear feeding track, each one of the plurality of tools being carried by corresponding modular drive units provided along the working zone at least on one side of the tree trunk for engagement with the tree trunk, each one of the drive units being moveable in a direction transverse to the feeding track for selected application of the corresponding tools between an operative position wherein the tools are adapted to contact the tree trunk and an idle position wherein the tools are adapted to be out of contact with the tree trunk.

2. The apparatus of claim 1, characterized in that the feeding means includes clamping means for holding the tree trunk such that the tree trunk is exposed at one of its longitudinal sides to be engaged by a selected one or more of the plurality of tools, all of the plurality of tools being being arranged on one side of the feeding track in the working zone for movement into engaging contact with the exposed side of the tree trunk.

3. The apparatus of claim 2, characterized in that the feeding track is a rail section and the feeding means includes a transport carriage moveable on one or more rails.

4. The apparatus of claim 3, characterized in that the clamping means is guidingly moveable in a direction transverse to the feeding track.

5. The apparatus of claim 4, characterized in that the clamping means comprise jaw-like gripper pairs disposed on a side of the tree trunk opposite the exposed side of the tree trunk, the gripper pairs being moveable to engage the tree trunk both from above and from below the tree trunk.

6. The apparatus of claim 5, characterized in that each one of the drive units is operable to carry a predetermined one of the plurality of tools.

7. The apparatus of claim 6, characterized in that each one of the drive units includes a modular base and is mountable in predetermined positions along the working zone of the feeding track.

8. The apparatus of claim 7, characterized in that there is provided a sequence of at least three working units, each unit carrying a predetermined one or more of the plurality of tools, the first working unit as viewed in a forward direction of the feeding means carrying at least one chipper for the flattening of the exposed side of the tree trunk, the second working unit carrying at least one edge miller for cutting out corners at a periphery of the tree trunk, the third working unit carrying at least one pair of saw blades for the separation of at least one from the tree trunk as defined by the corners cut out by the at least one miller.

9. The apparatus of claim 8, characterized in that there is provided a modular tool unit in at least one position along the working zone of the feeding track, the tool unit carrying a blade for the cutting production of thin boards from the tree trunk.

10. The apparatus of claim 1, wherein the feeding means comprises a feeder carriage that is moveable in a linear direction on at least one rail, the feeder carriage including clamping means for clamping the tree trunk, the clamping means including at least two clamping members positioned at a predetermined distance along a length of the tree trunk, at least one of the clamping members being adjustable in a horizontal plane such that a center axis of the clamped tree trunk is aligned in a horizontal plane in relation to a feeding direction of the carriage, characterized in that at least one of the clamping members is adjustable in height such that the axis of the clamped tree trunk is adjustable in a vertical plane.

11. The apparatus of to claim 10, characterized in that the clamping means are arranged on a common base frame rotatably mounted on the carriage about a pivotal axle.

12. The apparatus of to claim 10, characterized in that there are provided position control setting-devices on the carriage for adjustability of the clamping means.

* * * * *